US005997290A

United States Patent [19]

Hillingrathner

[11] Patent Number: 5,997,290

[45] Date of Patent: Dec. 7, 1999

[54] REVOLVING TRANSFER FURNACE FOR TREATING WORKPIECES

[76] Inventor: Franz Hillingrathner, Paseo Maritimo 2/9E, E-11010 Cadiz, Spain

[21] Appl. No.: 09/246,973

[22] Filed: Feb. 9, 1999

Related U.S. Application Data

[63] Continuation of application No. PCT/EP97/03805, Jul. 16, 1997.

[30] Foreign Application Priority Data

| | | | |
|---|---|---|---|
| Aug. 30, 1996 | [DE] | Germany | 196 35 257 |
| Sep. 18, 1996 | [DE] | Germany | 196 38 106 |
| Sep. 27, 1996 | [DE] | Germany | 196 39 933 |

[51] Int. Cl.[6] ..... F27B 9/16

[52] U.S. Cl. ..... 432/124; 432/131; 414/217

[58] Field of Search ..... 414/153, 180, 414/187, 217, 223; 432/137, 138, 128, 124, 131, 153; 226/251, 252, 259

[56] References Cited

U.S. PATENT DOCUMENTS

| | | | |
|---|---|---|---|
| 4,412,813 | 11/1983 | Wulf | 432/138 |
| 4,496,312 | 1/1985 | Yamada et al. | 432/138 |
| 4,626,203 | 12/1986 | Sakamoto . | |
| 4,666,358 | 5/1987 | Wojciechowski | 414/223 |
| 4,986,750 | 1/1991 | Sakamoto . | |
| 5,404,894 | 4/1995 | Shiraiwa | 414/217 |
| 5,722,825 | 3/1998 | Edenhofer | 432/138 |

FOREIGN PATENT DOCUMENTS

| | | |
|---|---|---|
| 0 098 344A1 | 1/1984 | European Pat. Off. . |
| 0 198871B1 | 4/1986 | European Pat. Off. . |
| 2 617953 | 1/1989 | France . |
| 4 005956C1 | 6/1991 | Germany . |
| 2 9505496 | 7/1995 | Germany . |
| 4 442152 A1 | 5/1996 | Germany . |
| 8 602103 | 4/1986 | WIPO . |

*Primary Examiner*—Philip H. Leung
*Assistant Examiner*—Gregory A. Wilson
*Attorney, Agent, or Firm*—Wooh, Herron & Evans L.L.P.

[57] ABSTRACT

A furnace body (10) houses a treatment rotor (30) which has charge locations (36) to take up a workpiece charge each and is supported so as to be driven in rotation around a central axis (A). The furnace body (10) communicates with side chambers (110, 110') equipped to receive a workpiece charge each from the treatment rotor (30) and to deliver it to the same, respectively. A lock rotor (60) likewise arranged in the furnace body (10) and adapted to be driven in rotation about the central axis (A) comprises at least two lock chambers (64) which are offset angularly relative to each other with respect to the central axis (A). The lock chambers (64) are opened alternately to the surroundings of the furnace body (10) and to a side chamber (110, 110') for reception and delivery of a workpiece charge each. Transfer apparatus (12) are provided for translating a respective workpiece charge between one each of the aforementioned chambers (64, 110, 110') and the treatment rotor, at least one those apparatus being designed for translating a workpiece charge each between the lock rotor (60) and the treatment rotor (30).

12 Claims, 12 Drawing Sheets

REVOLVING TRANSFER FURNACE FOR TREATING WORKPIECES

The present application is a continuation of applicant's PCT application PCT/EP97/03805, filed Jul. 16, 1997 and currently pending.

The invention relates to a revolving transfer furnace for treating workpieces, comprising a furnace body enclosing a furnace chamber adapted for an atmosphere which differs from the ambient air to be established inside the chamber, a treatment rotor arranged in the furnace body so as to be driven in rotation about a central axis and comprising a number of batch locations to each take up a batch of workpieces, side chambers connected to the furnace body and designed each for receiving a batch of workpieces from the treatment rotor and for delivering one to the same, at least two lock chambers disposed angularly offset relative to each other with respect to the central axis and being opened alternately to the surroundings of the furnace body and to a side chamber so as to each receive and deliver a batch of workpieces, and transfer apparatus for translating a batch of workpieces each between a respective one of the aforementioned chambers and the treatment rotor.

Revolving transfer furnaces of this kind, also referred to as circular fixed-cycle furnaces, are especially well suited for heat treatment of metallic workpieces, such as carburizing, nitriding, phosphating, and/or tempering. In a conventional revolving transfer furnace of the generic type in question (DE 295 05 496 U1) an entry lock located outside of the furnace body is accessible through an entry gate and separated by a first intermediate gate from a heating chamber which in turn is separated by a second intermediate gate from an equilizing chamber. The equalizing chamber is built on to the furnace body radially from outside and separated from it by a third intermediate gate. Workpieces which are to be carburized and then tempered are arranged in batches or charges on a pallet. Transfer equipment pushes the pallets successively through the entry lock, the heating chamber, and the equalizing chamber into the furnace chamber. To accomplish that, the above mentioned gates must be opened one after the other and must each be closed prior to the opening of the next successive one so that a desired atmosphere, which differs from ambient air, can be maintained in the chambers mentioned and in the furnace chamber. Two carburizing chambers are joined to the furnace body, radially from outside; they are angularly offset from each other and also with respect to the equalizing chamber. These chambers, too, are each separated from the furnace chamber by a gate which usually is closed. The same applies to a tempering furnace, likewise joined to the furnace body radially from outside. The tempering furnace is followed by an exit lock which is suitable also for quenching the workpieces which have been heated to hardening temperatures in the tempering furnace. With a given furnace body diameter, this known arrangement needs relatively great space and involves considerable maintenance expenditure for the numerous gates required for the locks and all the other chambers.

The same can be said of other conventional revolving transfer furnaces of the kind specified initially (DE 40 05 956 C1 and EP 0 198 871 B1).

It is the object of the invention to provide a cost and space-saving revolving transfer furnace for workpiece treatment, especially for tempering and annealing metallic workpieces which furnace also lends itself to time-saving operation.

Starting from a revolving transfer furnace of the kind defined above, the object mentioned is met, in accordance with the invention, in that:

the lock chambers are located in a lock rotor which likewise is arranged in the furnace body and adapted to be driven in rotation about the central axis such that at least one lock chamber each is periodically opened towards one of the side chambers, and at least one of the transfer apparatus is designed to translate one batch of workpieces each between the lock rotor and the treatment rotor.

Locating the locks in a lock rotor which is coaxial with the treatment rotor offers particularly easy control of the opening and closing of the lock chambers and further makes it possible to do with but little space for the entire assembly, even if quite a few more than the customary two locks are provided.

It is convenient for the two rotors, coordinated with each other according to the invention, to be driven separately and at different speeds. To make one revolution, the treatment rotor needs a period of time in correspondence with the necessary residence time of the workpieces. The lock rotor, on the other hand, only needs, e.g. 1/12 of that time for each full revolution. In principle, both rotors can be operated in a continuous mode as long as the angular velocity of both of them is low and the batches of workpieces consist of only one rather big piece or are introduced and removed on racks, pallets, and the like. Generally, however, stepwise operation of the revolving transfer furnace is preferred. To accomplish that, the revolving transfer furnace preferably is developed further in that the number of batch locations of the treatment rotor which are disposed in a common plane is an integer multiple of the number of lock chambers of the lock rotor, and both rotors are adapted to be driven stepwise in rotation such that the angular dimension of each step of the lock rotor is the same size multiple of each step of the treatment rotor.

If workpieces are to be treated which must be subjected to different influences over rather long periods of time and, therefore, have to stay for a while in different temperature zones, for instance, the revolving transfer furnace may be developed further in that the treatment rotor comprises at least two turntables which are axially offset with respect to each other, thermally insulated from each other, and adapted to be heated differently.

In some cases it is sufficient for at least one side chamber to include a means for cooling a respective batch of workpieces or to be connectable to such cooling means. The cooling means may be embodied by a conventional quenching facilities, such as a nitrogen shower, an oil bath, and the like. It is likewise feasible to provide another turntable for cooling the workpieces. Preferably, however, the lock rotor is of such design that it can cool the workpieces. To this end, a coolant channel may be arranged at the furnace body so as to extend through an arc corresponding to at least one step of the lock rotor and be separated from adjacent side chambers, the coolant channel communicating throughout its arc length with at least one of the lock chambers.

The revolving transfer furnace need be furnished with only one sealing arrangement to seal moving parts from non-moving ones. This may be realized in that the furnace body comprises at least one annular stationary sealing surface and the lock rotor comprises a co-rotating sealing surface, and a sealing ring which is fixed against rotation is disposed between those two sealing surfaces and formed with suitable passages, being the same in number and arrangement as the lock chambers, to permit a batch of workpieces to pass.

Although it is also possible to provide for direct cooperation between a stationary sealing surface formed at the furnace body and a sealing surface formed at the lock rotor or rotating together with the same, a sealing ring positioned in accordance with the invention has the advantage of presenting a relatively soft intermediate member which is subject to wear, can be produced at low cost, and exchanged quickly, in contrast to its two contact partners. Moreover, the sealing ring is adapted to compensate concentricity errors and thermal expansions, especially so if the sealing surfaces formed on the furnace body and the lock rotor converge conically and the sealing ring has a corresponding wedge-shaped profile and is biased in axial direction.

Basically, the central axis of the revolving transfer furnace may have any desired position in space. For instance, it may be positioned horizontally if it is ensured that the workpieces to be treated are supported sufficiently, e.g. in a swinging mode, in the lock chambers and at the batch locations, either individually or in greater batches, such as by being threaded on racks. A modification of the revolving transfer furnace has proved to be particularly advantageous in which the central axis is disposed vertically, each batch location comprises a plurality of fins which are disposed substantially radially with respect to the central axis but parallel to one another and essentially on edge, each lock chamber includes a lock location formed by fins which are arranged accordingly, the transfer apparatus each comprise a radially displaceable fin comb which fits between the fins of the batch and lock locations, and the fin comb of each transfer apparatus is adapted to be raised and lowered between positions in height corresponding to those of the rotors.

The revolving transfer furnace according to the invention may be developed further such that at least one side chamber is disposed opposite another side chamber so that one lock chamber and one batch location each are simultaneously accessible from these two side chambers, and these two side chambers contain one each of the transfer apparatus which are controllable such that one of them will translate a batch of workpieces from the lock rotor to the treatment rotor while the other one, at the same time, translates a batch of workpieces from the treatment rotor to the lock rotor.

In this manner the inactive periods of both rotors can be kept very short, at intermittent rotation of the same. Advantageous modifications may be gathered from claims 8 and 9. Continuous rotation of the two rotors is feasible as well, provided the transfer equipment is designed accordingly.

The features recited in claims 10 to 12 permit the revolving transfer furnace to be developed further with a view to improving its performance, at low consumption of energy as well as machinery and materials, more specifically its precisely metered action upon the workpieces, in particular steel workpieces of little mass which are to be tempered.

The invention will be described further, by way of example, with reference to the accompanying drawings, in which.

Figure 1:
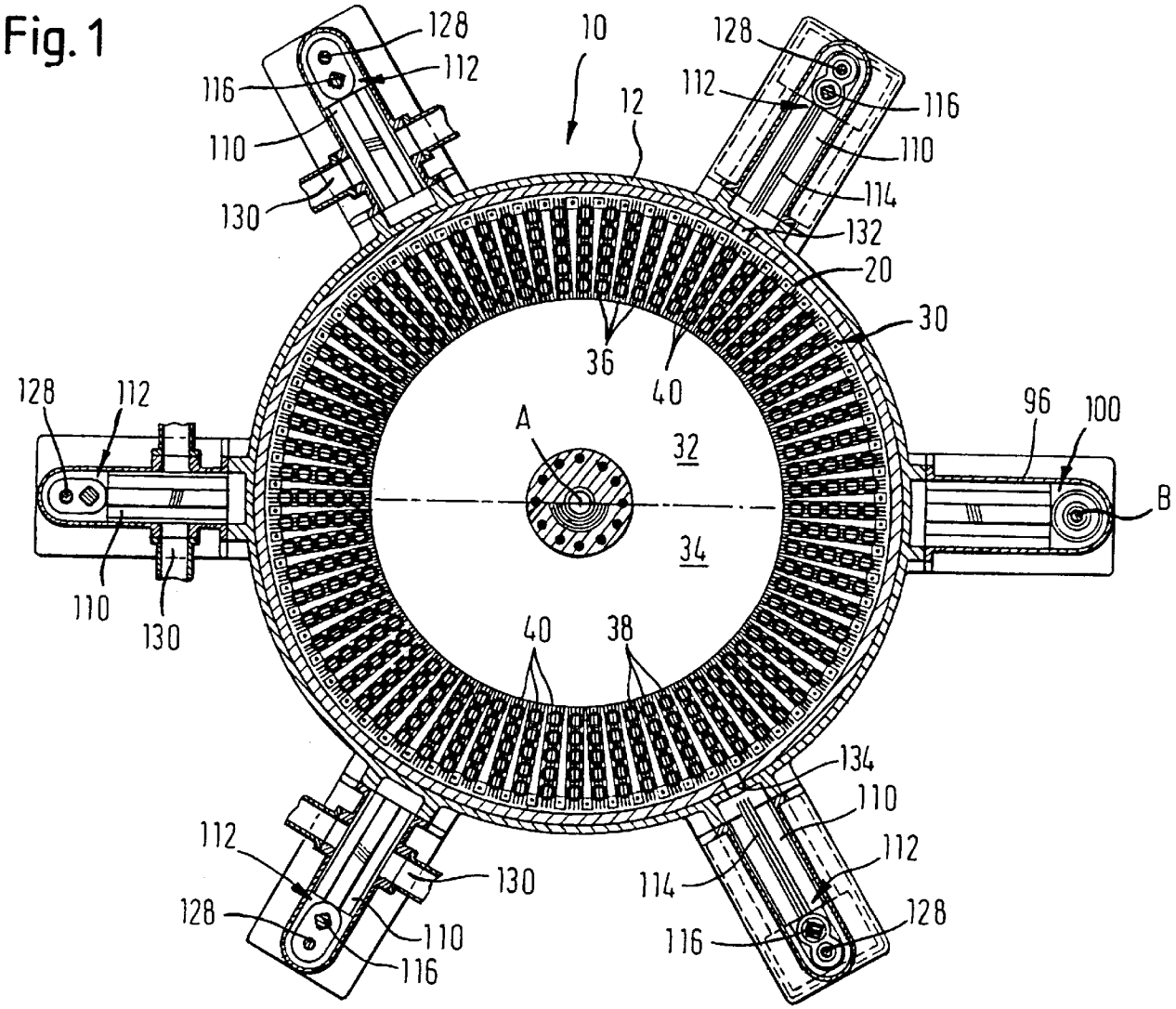
FIG. 1 is a top plan view, partly in horizontal section I—I of FIG. 3, illustrating a first embodiment of a revolving transfer furnace according to the invention.

The revolving transfer furnace shown in FIGS. 1 to 6 comprises a furnace body 10 defined by an essentially cylindrical outer wall 12, a bottom 14, and a partition 16, these elements together enclosing a furnace chamber 20 which can be evacuated. The furnace further comprises a cover 18 and a lower body portion 22 which is made in one piece with the outer wall 12 and the bottom 14.

The partition 16 is formed with an upwardly projecting cylindrical collar 24 in which radially inner bearings 26 support a hub 28 of a treatment rotor 30 for rotation around a vertical central axis A. The essential components of the treatment rotor 30 are an upper turntable 32 and a lower turntable 34, both of circular ring shape and presenting numerous batch locations 36 and 38, respectively. In the embodiment shown there are seventy-two such locations each. Each batch location 36 and 38 is formed by a plurality of horizontal fins 40 positioned on edge and extending parallel to one another and substantially radially away from the central axis A. They are held together by a common bottom plate 42 of circular ring shape.

The treatment rotor 30 further comprises three insulating plates 44, 46, and 48 positioned one below the other, coaxially with the central axis A. The upper batch locations 36 are located between the upper and middle insulating plates 44 and 46, respectively, while the lower batch locations 38 are located between the middle and lower insulating plates 46 and 48, respectively, the arrangement being such that there is room at each batch location for a batch of workpieces W to be treated. The insulating plates 44, 46, and 48 preferably are composite plates, each being composed of two thin ceramic plates and three thick insulating plates made of hardened graphite felt. All the plates 44, 46, and 48 are connected rigidly but exchangeably to the hub 28 by means of paraxial tie bolts 49. The resulting treatment rotor 30 is adapted to be driven stepwise in rotation about the central axis A by a motor 50. Each step is 5° wide, with the selected number of seventy-two batch places 36 and 38 on each of the two turntables 32 and 34 in the example chosen here. In order for this step width to be observed with precision, the motor 50 preferably is a servo motor with a built-in transmission free from play, such as a cyclo gear transmission.

The batch locations 36 of the upper turntable 32 are located between two annular heating discs 52 which are concentric with the central axis A and serve for high temperature heating. Similarly, the batch locations 38 of the lower turntable 34 are located between two heating discs 54 for low temperature heating. All the heating discs 52 and 54 are scalloped in star shape to conform to the arrangement of the batch locations 36 and 38. They are preferably made of molybdenum or graphite, and they are connected to an electrical power source by way of a central slip ring arrangement 56. Below the slip ring arrangement 56, the furnace body 10 is closed by a cup-shaped closure member 58.

A lock rotor 60 is disposed within the furnace body 10 above the treatment rotor 30 and separated from it by the partition 16. The lock rotor 60, too, is supported on the collar 24, yet by means of outer bearings 62, and it is also adapted to be driven in rotation about the central axis A. The lock rotor 60 comprises a plurality of lock chambers 64, six in the embodiment shown, which are offset from each other at angular spacings of 60° and each formed in a spoke-like part of the lock rotor. In the embodiment illustrated in FIGS. 1 to 6 they are open only radially outwardly. First, second, and third exhaust nipples 66, 67, and 68 are provided on the outer wall 12 of the furnace body 10 at angular spacings in the direction of rotation C. They are connectable to a suction pump for evacuation of the lock chamber.

Horizontal fins 70 are disposed on edge in each lock chamber 64. They extend parallel to one another at the same mutual spacing as the fins 40 and substantially radially away from the central axis A, being interconnected by a bottom plate 72. Just like the bottom plates 42 of the treatment rotor 30, the bottom plates 72 of the lock rotor 60 function to prevent oscillations of the associated fins 70 and 40, respectively, especially during rapid acceleration or deceleration of the lock rotor 60 or treatment rotor 30, respectively. The fins 70 in each lock chamber 64 define a lock location 74 at which a batch of workpieces W can be deposited.

Each batch, for example, consists of five annular workpieces W, e.g. ball bearing races, disposed radially one behind the other. In case the workpieces W to be treated are balls, the fins 40 and 70 each are formed with a notch in their top surface, as illustrated at one of the fins 70 in FIG. 5. Each ball thus will be received securely in notches of two adjacent fins. It is also possible to place the batches of workpieces on a pallet each.

Figure 2:
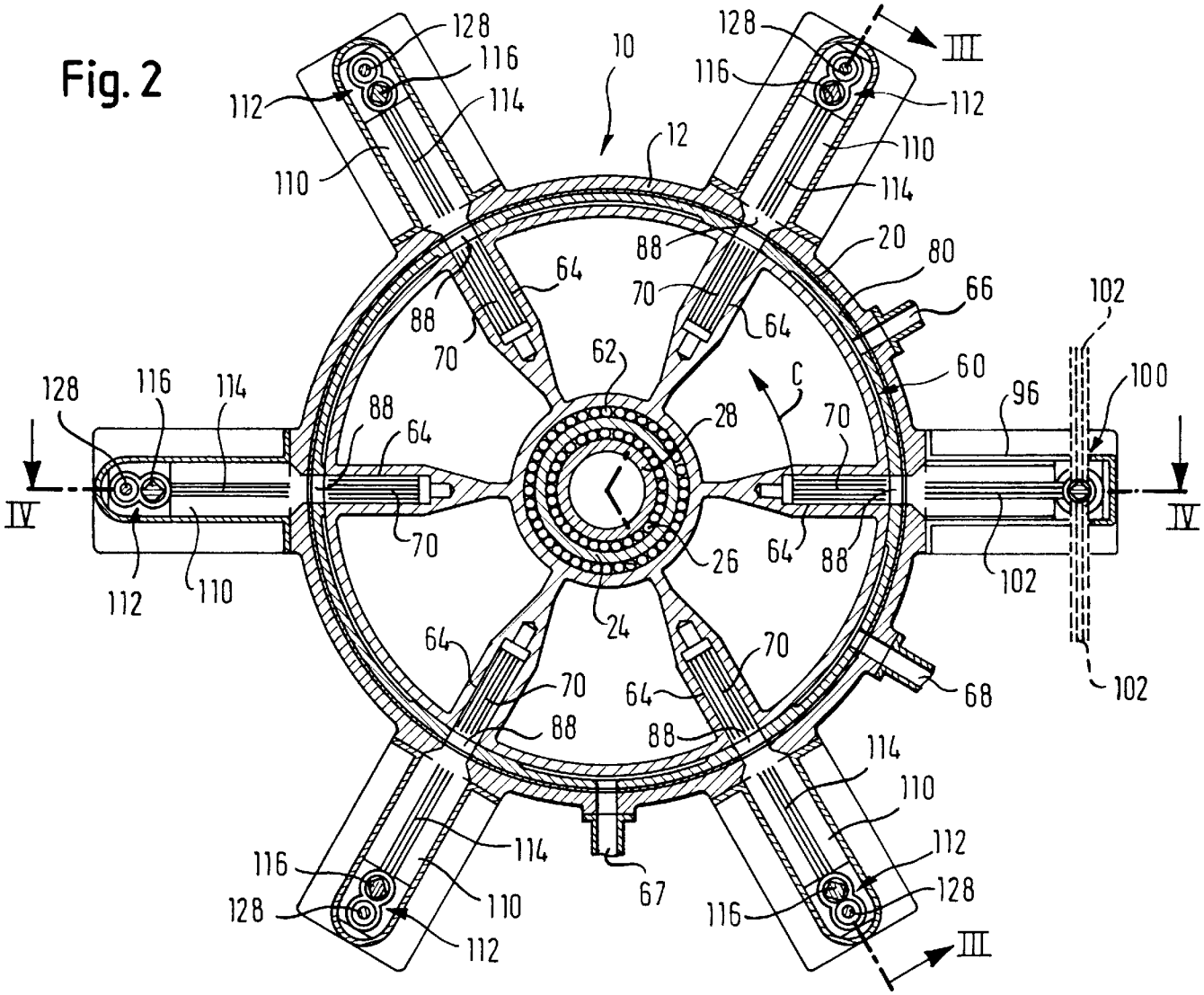
FIG. 2 shows the section in horizontal plane II—II of FIG. 3.
Figure 3:
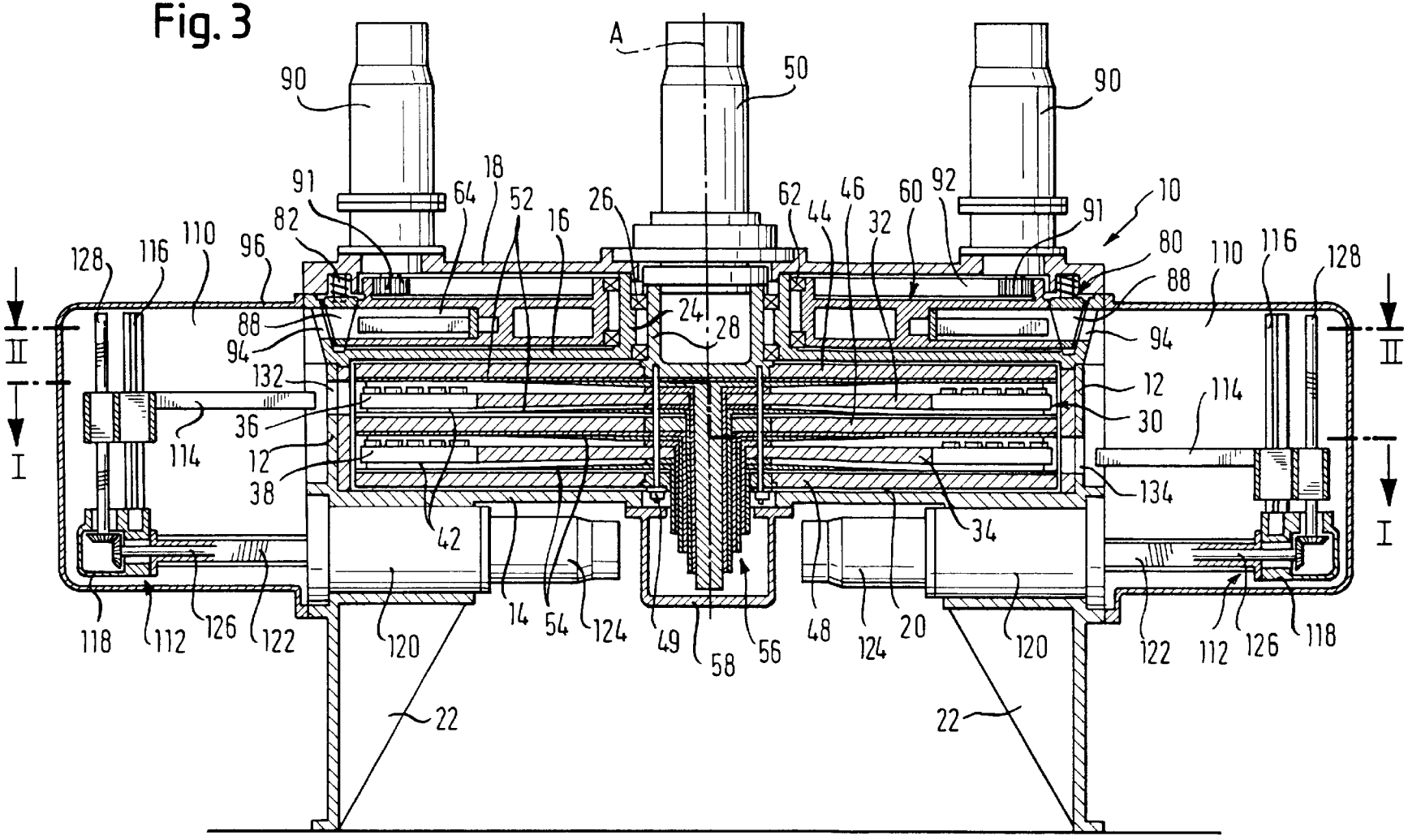
FIG. 3 shows vertical section III—III of FIG. 2.
Figure 4:
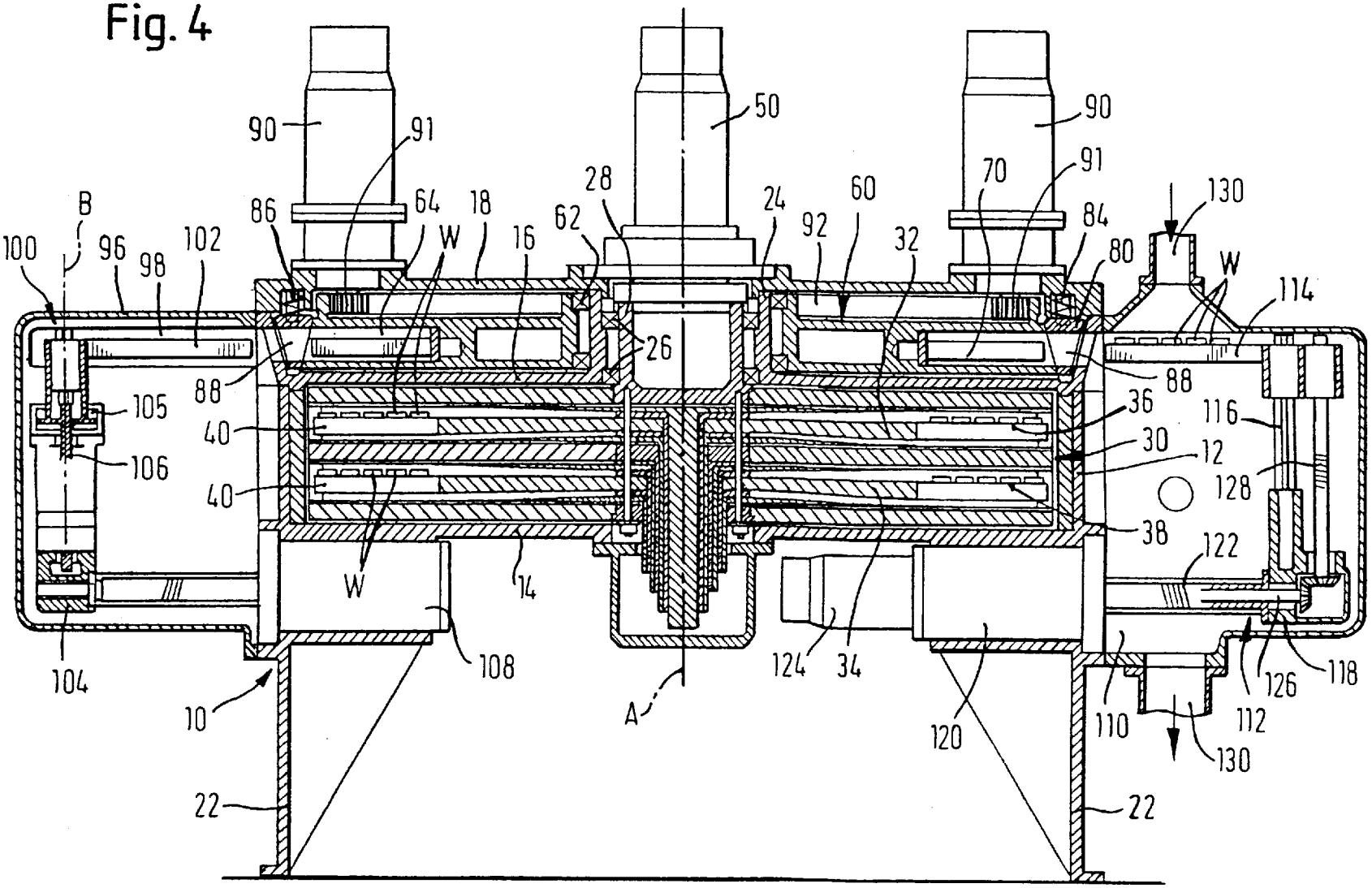
FIG. 4 shows vertical section IV—IV of FIG. 2.
Figure 5:
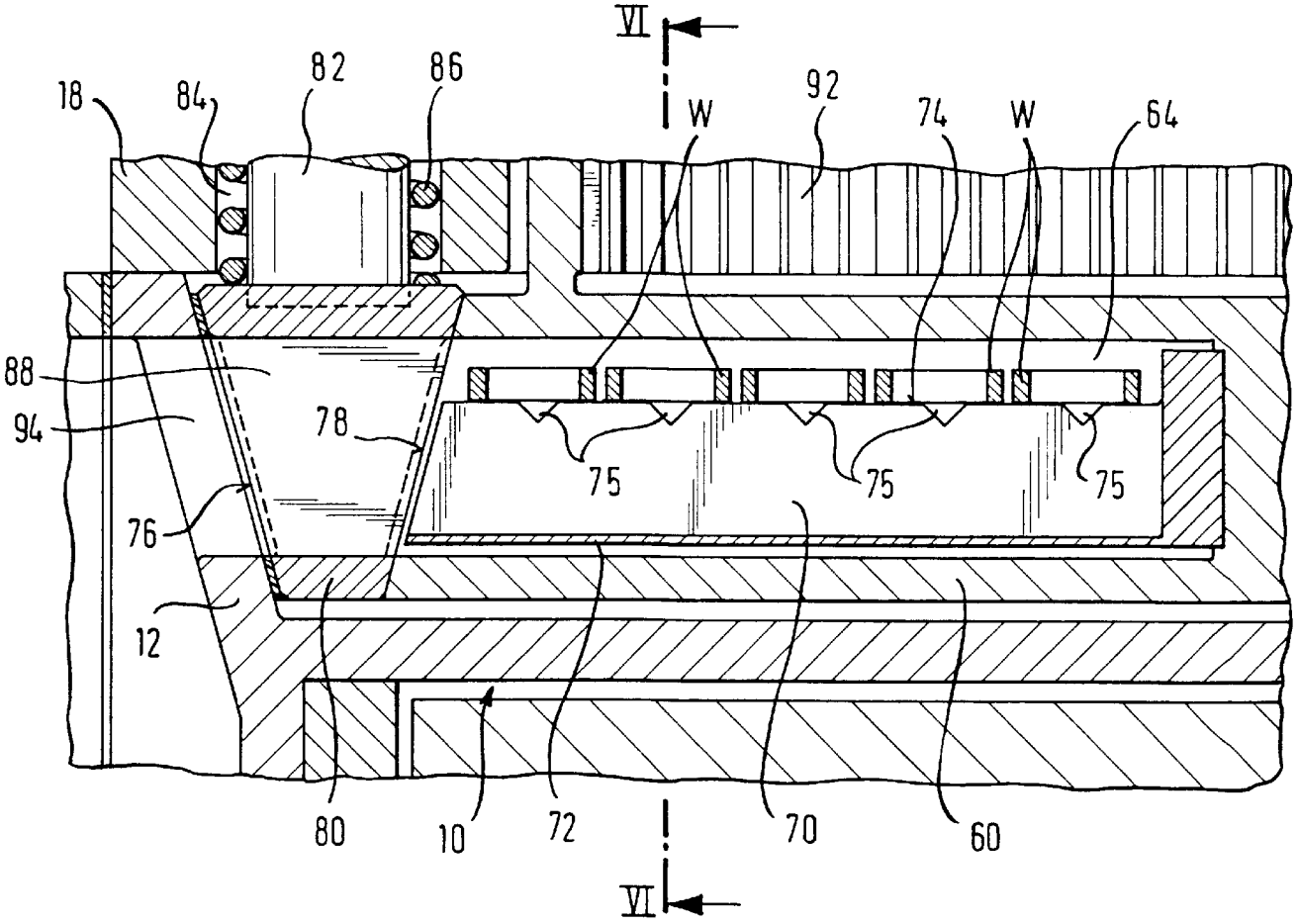
FIG. 5 shows a greatly enlarged cutout of FIG. 4.
Figure 6:
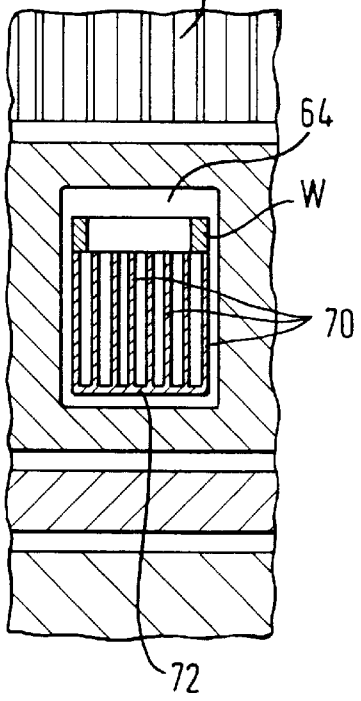
FIG. 6 shows vertical section VI—VI of FIG. 5.

All around the lock rotor 60 the furnace body 10 is formed with a stationary sealing surface 76 shaped like an internal cone whose smallest diameter is at the bottom, as seen in FIG. 5. The lock rotor 60 likewise is formed with a conical outer sealing surface 78 having its greatest diameter at the bottom and preferably carrying a ceramics coat. A sealing ring 80 of appropriate conical shape is placed between the sealing surfaces 76 and 78, its profile being that of a downwardly tapering wedge. Preferably it is made essentially of graphitized carbon or partly crystalline thermoplastic material (PEEK). Its outer conical surface is provided with an elastomeric coating which abuts against the stationary sealing surface 76, whereas its engagement with the outer sealing surface 78 of the lock rotor 60 is direct. A pin 82 fixed to the sealing ring 80 and extending parallel to the central axis A and engaging in a recess 84 formed in the cover 18 prevents the sealing ring 80 from turning. The sealing ring 80 is biased in axial downward direction by springs 86 supported on the cover 18. As shown in FIG. 2, six passages 88 are formed in the sealing ring. They are angularly spaced by 60° and become aligned with one each of the lock chambers 64 whenever the lock rotor 60 is standing still.

The lock rotor 60 is designed for stepwise rotation by means of two motors 90. With the number of six lock chambers 64 chosen here as an example, each step extends through 60°. The two motors 90, preferably electric servo motors, are mounted offset by 180° from each other and each comprise a step-down gear free from play including a pinion 91 which engages, free from play, in a ring gear 92 provided on the lock rotor 60.

The outer wall 12 of the furnace body 10 is thermally insulated, e.g. by hardened graphite felt and has six radial openings 94, mutally offset by 60°, at the level of the lock rotor 60. These openings each are aligned with a respective one of the passages 88 in the sealing ring 80. In the area of one of the openings 94, an enclosure 96 is attached radially from outside to the outer wall 12 of the furnace body 10. It communicates with the surroundings of the furnace body 10 through slots 98 at the level of the lock rotor 60. The enclosure 96 houses a loading device 100 for introducing and removing batches of workpieces into and from the lock chambers 64. The loading device 100 includes a fin comb 102 which fits between the fins 70 of the lock rotor 60, each group of fins presenting one of the lock locations 74. The fin comb 102 can be raised and lowered somewhat along a vertical pivot axis B. And it can be swung outwardly through 90° in either direction about this pivot axis B, from a position which is radial with respect to the central axis A, passing during this outward swinging movement through a respective one of the slots 98 provided in the enclosure 96. The fin comb 102 is mounted on a slide 104 which is movable radially towards and away from the central axis A. The raising and lowering motions are produced by a lifting drive 105, the swinging motions by a pivot drive 106, and the radial displacements by a shifting drive 108; these three drive means likewise may each comprise an electric servomotor.

With the embodiment of the revolving transfer furnace shown in FIGS. 1 to 6, the five other openings 94 provided in the outer wall 12 of the furnace body 10 each open into a side chamber 110 which is hermetically sealed off from the outside and in which a transfer apparatus 112 operates. Each one of the total of five transfer apparatus 112 comprises a fin comb 114 corresponding to the fin comb 102 but constantly remaining oriented radially, in contrast to the fin comb 102. The fin comb 114, however, is adjustable along a vertical column 116 between levels which correspond to those of the two turntables 32 and 34 and the lock chambers 64. The column 116 is fastened on a slide 118 which is displaceable radially towards and away from the central axis A by means of a motor 120. The motor 120 drives a nut which generates reciprocating movement of a hollow spindle 122 secured to the slide 118. Another motor 124 is provided to produce lifting motions, it is flange-connected coaxially with the motor 120 and drives a shaft 126. The shaft 126 passes through the hollow spindle 122 and drives a vertical spindle 128 in threaded engagement with the fin comb 114 so as to raise and lower the same.

At least one of the side chambers 110 may include a means 130 for cooling or quenching the previously heated workpieces W. As indicated in the right part of FIG. 4, this means 130 may be designed in such a way that a cooling gas, for example nitrogen, may be circulated through the respective side chamber 110. Alternatively, the means for quenching may be embodied by an oil bath in one of the side chambers 110.

In addition to the opening 94 which establishes communication between the first side chamber 110, following the enclosure 96 in the direction of arrow C in FIG. 2, and the lock rotor 60, another opening 132 likewise formed in the outer wall 12 opens into the first side chamber 110 and connects this side chamber to the upper turntable 32. An opening 134 opens into the last side chamber 110 to connect the latter to the lower turntable 34. All the openings 94, 132, and 134 in the outer wall 12 of the furnace body 10 as well as the passages 88 in the sealing ring 80 are so dimensioned that one of the fin combs 102 or 114 can be pushed through to enter between the fins 40 of the treatment rotor 30 or the fins 70 of the lock rotor 60, respectively.

The revolving transfer furnace shown in FIGS. 1 to 6 operates as follows:

As indicated in FIG. 2, the fin comb 102 of the loading device 100 is swung out of the enclosure 96, for example, in clockwise sense and is loaded with a batch of workpieces W. That may be done by either putting the workpieces directly on the fin comb 102 or placing them on a pallet or threading them on a rack which subsequently is taken over by the fin comb 102. Thereupon the fin comb 102 together with the batch of workpieces is swung into its normal radial position and then moved radially inwardly, while the lock rotor 60 is at standstill. Thus it enters the particular lock chamber 64 which happens to be aligned radially with the fin comb 102. During this procedure the fin comb 102 is located at a level which is slightly above the top edge of the fins 70. As soon as the fin comb 102 has reached its radially inner position, it is lowered so far that its batch of workpieces will come to rest on the fins 70 and thus be located at the lock location 74 of the respective lock chamber 64.

Next, the fin comb 102 is retracted radially outwardly and the lock rotor 60 is turned by one step which means through 60° in the example shown. This rotation, for example, may be effected in anticlockwise sense, as indicated by arrow C in FIG. 2. At the same time, the lock chamber 64 loaded with the first batch of workpieces moves past the first exhaust nipple 66. This lock chamber 64, once evacuated, next reaches the position at which it is aligned with the first side chamber 110. The transfer apparatus 112 which it encounters there removes the batch of workpieces radially from the lock chamber 64, takes them down to the level of the upper turntable 32, pushes them in radial direction into this turntable and sets them down on one of the batch locations 36 of the turntable as it is slightly lowered a little more. Subsequently, the treatment rotor 30 is turned by one step, i.e. it is rotated through 5°.

This sequence of operations is repeated with successive lock chambers 64 of the lock rotor 60 and with successive batch locations 36 of the upper turntable 32 until the latter is fully charged, in other words loaded with a total of seventy-two workpiece batches in the example shown.

As soon as the batch of workpieces loaded first on the upper turntable 32 has taken part in a full revolution of the treatment rotor 30, having been heated by the upper two heating discs 52 to a certain temperature sufficient for tempering, for instance, the transfer apparatus 112 disposed in the first side chamber 110 enters into action to lift this batch of workpieces from its batch location 36 on the upper turntable 32 and put it down in the lock chamber 64 located above it which has just become free. During the next step of movement of the lock rotor 60, therefore, this heated batch of workpieces will get into a position opposite the second side chamber 110, after the enclosure 96 in the direction of arrow C in FIG. 2. The transfer apparatus 112 in that side chamber removes the batch of workpieces from the lock rotor 60 in order to expose this batch to a nitrogen shower or dip it into an oil bath so as to quench the workpieces W of the batch in question.

Following that, the same transfer apparatus 112 in the same second side chamber 110 positions the batch of workpieces under consideration at the same empty lock location 74, and the lock rotor 60 is turned another step. The batch of workpieces in question thus reaches the region which lies radially inside the third side chamber 110 whose transfer apparatus 112 picks up the batch of workpieces which then is cooled down further inside the third side chamber 110 and subsequently returned to its former lock location 74. After the lock rotor 60 has carried out another step, the batch of workpieces in question is cooled still further, if needed, in the fourth side chamber 110 and then brought back to its previous lock location 74.

The next step of the lock rotor 60 brings the batch of workpieces, now sufficiently cooled, to the fifth side chamber 110. On its way, the lock chamber 64 containing this batch of workpieces moves past the second exhaust nipple 67 whereby it is freed of its coolant, e.g. nitrogen, or of oil vapors. The batch of workpieces under consideration is removed from its lock chamber 64 by the transfer apparatus 112 of the fifth side chamber 110 and put down at a batch location 38 of the lower turntable 34. This sequence of operations is repeated until also the lower turntable 34 is fully loaded with batches of workpieces.

On the lower turntable 34 the batch of workpieces in question and each successive one again take part in a complete revolution of the treatment rotor 30 so as to be heated to an annealing temperature. Thereupon each batch of workpieces is picked up by the transfer apparatus 112 in the fifth side chamber 110 and placed on the lock location 74 which has just become free and is waiting vertically above the lower batch location 38 so far occupied by the batch of workpieces. Finally, the batch of workpieces in question and each successive one take part in a last step of the lock rotor 60, whereby they are moved past the third exhaust nipple 68 to once again enter the realm of the loading device 100 which meets them and translates them out of the enclosure 96 into the open.

Figure 7:
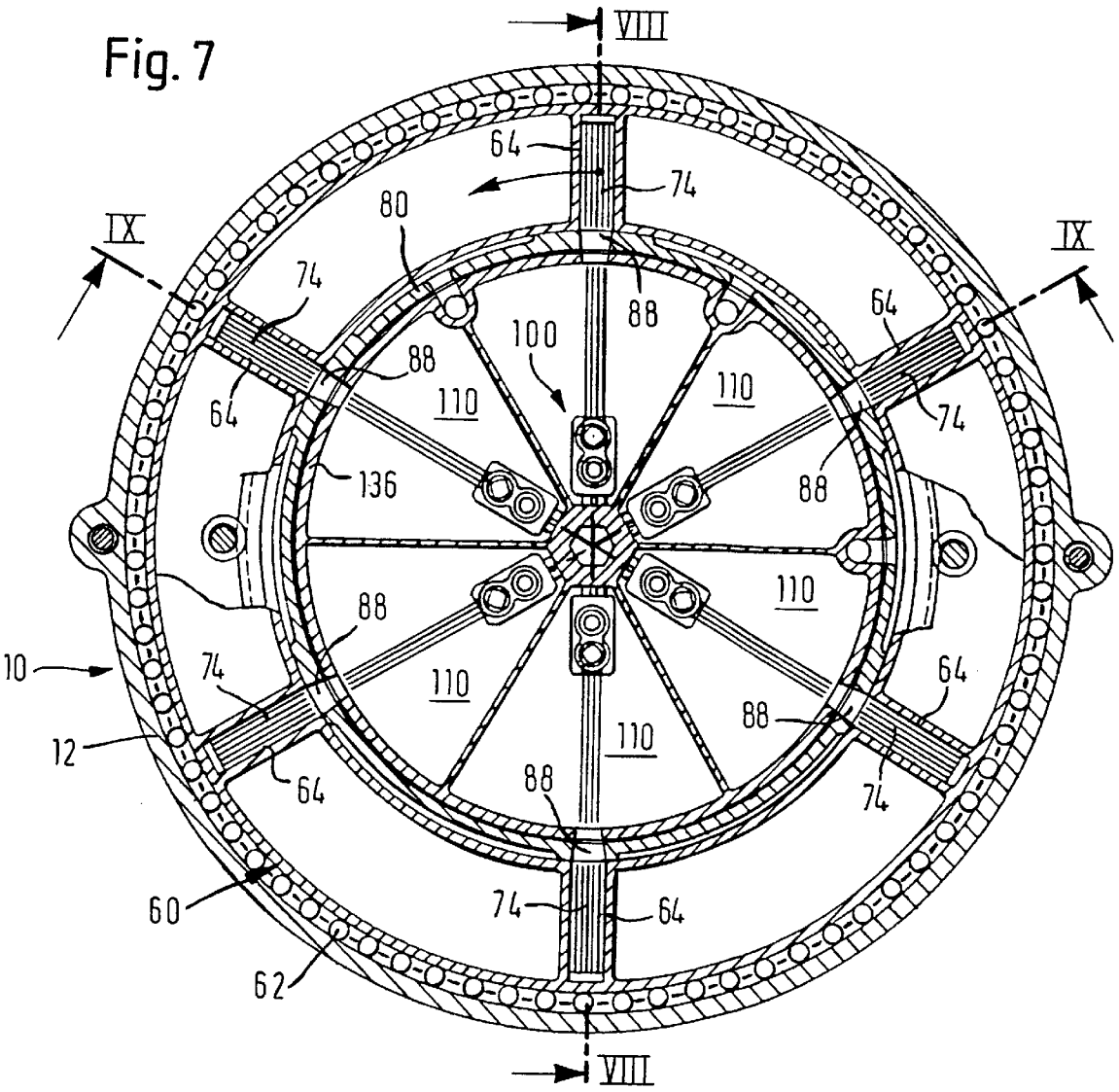
FIG. 7 shows a second embodiment of a revolving transfer furnace in horizontal section VII—VII of FIG. 9.
Figure 8:
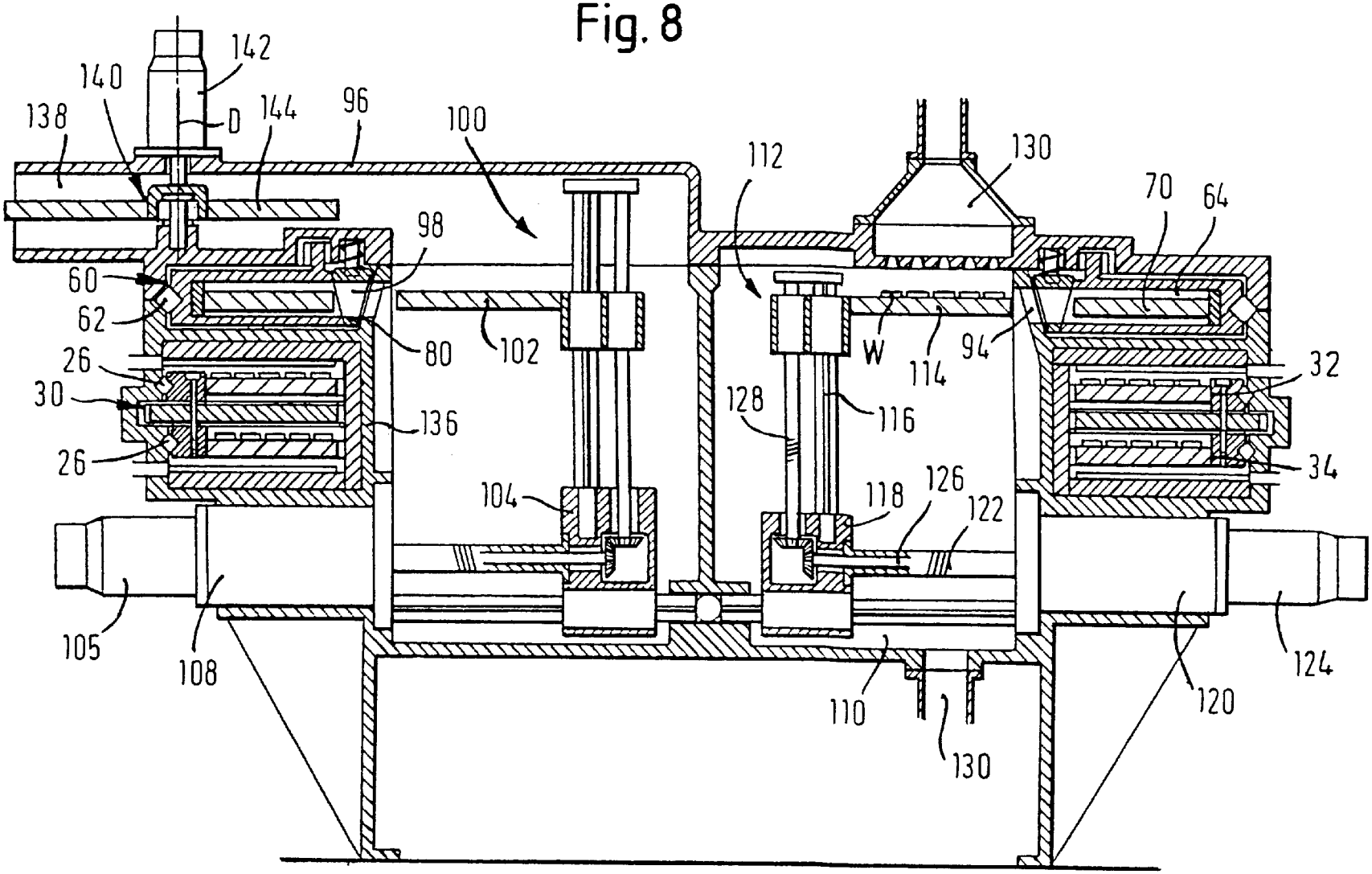
FIG. 8 shows vertical section VIII—VIII of FIG. 7.
Figure 9:
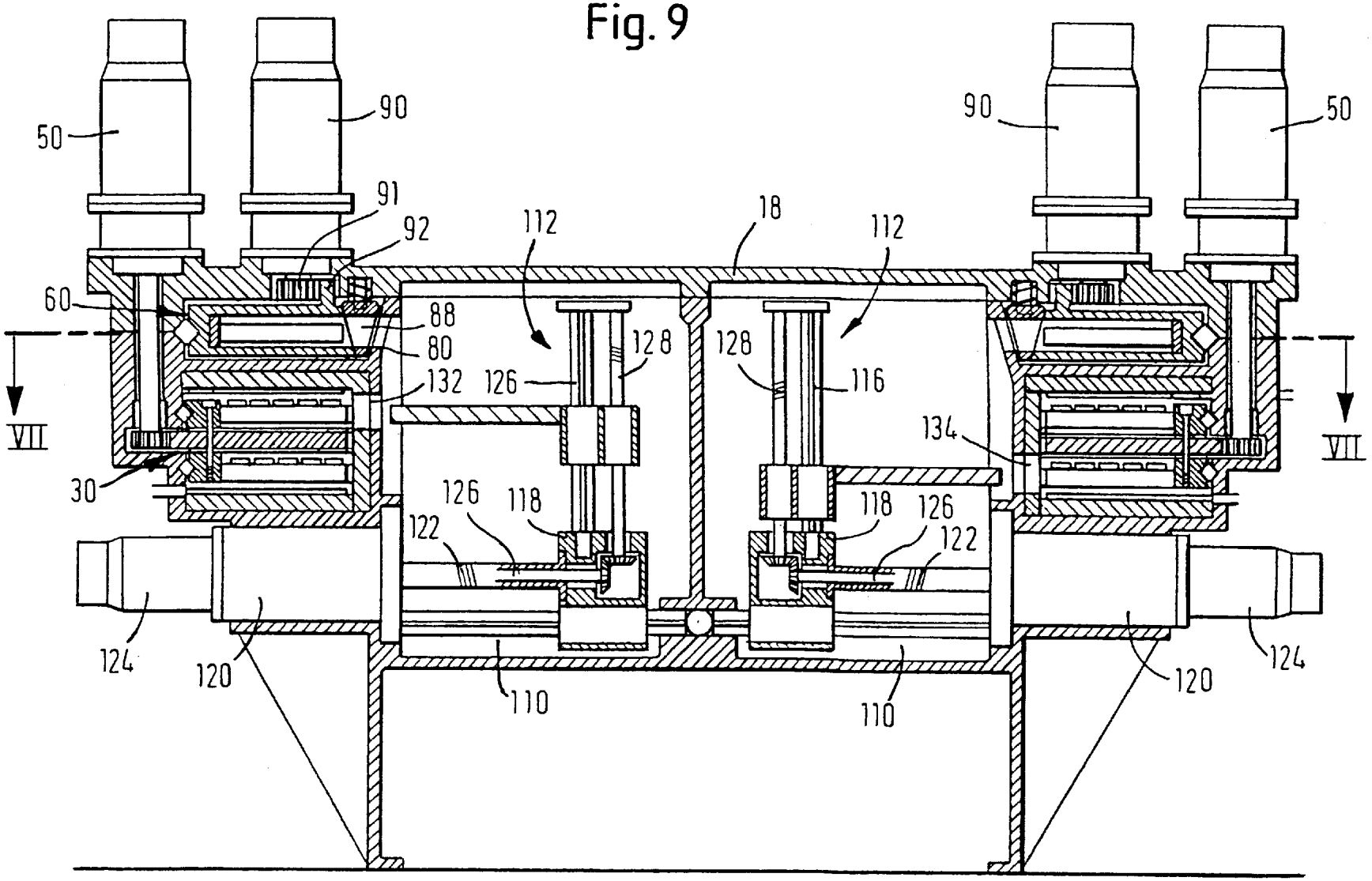
FIG. 9 shows vertical section IX—IX of FIG. 7.

The revolving transfer furnace according to FIGS. 7 to 9 differs from the embodiment according to FIGS. 1 to 6 by the fact that the treatment rotor 30 and the lock rotor 60 are supported at radially outer locations, their bearings 26 and 62 being disposed at the outer wall 12 of the furnace body 10. The space defined radially inside the two rotors 30 and 60 is utilized to house the enclosure 96 including the loading device 100 as well as five side chambers 110, each with their transfer apparatus 112. The arrangement of the loading device 100 and the transfer apparatus 112 in the embodiment of FIGS. 7 to 9 is inverted by comparison with that of FIGS. 1 to 6. This means that the fin combs 102 and 114 have the free ends of their fins directed radially outwardly. The sealing ring 80 cooperates to establish a seal with a cylindrical inner wall 136 of the furnace body 10, which wall is formed with the openings 94, 132, and 134. The lock chambers 64 are open in radially inward direction, as seen in FIGS. 7 to 9. The lock locations 74 and the batch locations 36 and 38, therefore, are each charged in radial direction from the inside to the outside with a respective batch of workpieces, and these are withdrawn in the opposite direction.

The enclosure 96 defines a supply channel 138 which extends radially outwardly above the cover 18 of the furnace body 10. A rotary member 140 is supported in the supply channel 138 in a manner so as to be rotatable in steps of 180° each about a vertical axis of rotation D with the aid of a motor 142. The rotary member 140 comprises two diametrically opposed sets of fins 144 into which the fin comb 102 of the loading device 100 can enter in radial direction. The loading device 100 cooperates with the rotary member 140 in the same fashion as with the lock rotor 60 for putting down and removing batches of workpieces. Otherwise the mode of operation of the revolving transfer furnace illustrated in FIGS. 7 to 9 is similar to that described above with reference to FIGS. 1 to 6.

In the case of the revolving transfer furnace illustrated in FIGS. 10 to 14 the furnace body 10 includes not only the upper partition 16 but also a lower partition 17. The upper turntable 32 of the treatment rotor 30 is located between the two partitions 16 and 17 in a portion of the furnace chamber 20 adapted to be evacuated. The lower turntable 34 is located between the bottom 14 and the lower partition 17 in a portion of the furnace chamber 20 which normally is not evacuated but instead filled with atmospheric air or an inert gas, such as nitrogen. The two turntables 32 and 34 are sealed off from each other, thermally insulated against each other, and independently heatable. As may be seen in FIG. 12, each of the two motors 50 drives two pinions 51 in constant meshing engagement with upper and lower ring gears, respectively, of the upper and lower turntables 32 and 34, respectively.

The two turntables 32 and 34, instead of being arranged in portions of the furnace chamber 20 which are separated from each other by the lower partition 17, as shown in the drawing, also may be embodied each by a double-disc assembly sealed off from the furnace body 10 and thus each may present a defined portion of the furnace chamber 20 itself. In this event it is sufficient for the treatment rotor 30 to be formed with only one common ring gear for both turntables 32 and 34, as with the embodiments according to FIGS. 1 to 9, the motors 50 accordingly driving only one pinion 51 each.

In the embodiment according to FIGS. 10 to 14, too, the lock rotor 60 comprises six lock chambers 64 mutually offset at angular spacings of 60°. Yet contrary to the preceding embodiments they are open radially outwardly as well as radially inwardly. Around the lock rotor 60, the furnace body 10 is formed with a stationary, radially outer sealing surface 76 shaped like an inner cone having its smallest diameter at the bottom end. Concentrically with this sealing surface, the furnace body 10 is formed with another stationary, radially inner sealing surface 76' shaped like an outer cone having its greatest diameter at the bottom end. The lock rotor 60 also is formed with a conical, radially outer sealing surface 78 having its greatest diameter at the bottom, and with a conical, radially inner sealing surface 78' having its smallest diameter at the bottom. An outer sealing ring 80 of corresponding conical configuration, its profile resembling a downwardly tapering wedge, is inserted between the sealing surfaces 76 and 78. An inner sealing ring 80', corresponding to the outer sealing ring 80 but being of smaller diameter, is positioned between the sealing surfaces 76' and 78'. Each sealing ring 80 and 80' is prevented from rotating by a corresponding feather 160 and 160' attached to it, extending parallel to the central axis A, and engaging in a corresponding recess 84 and 84' each, formed in the cover 18. Pistons 162 and 162', respectively, guided in the cover 18 and acted upon by pressurized gas, such as nitrogen, bias the sealing rings axially in downward direction.

Figure 10:
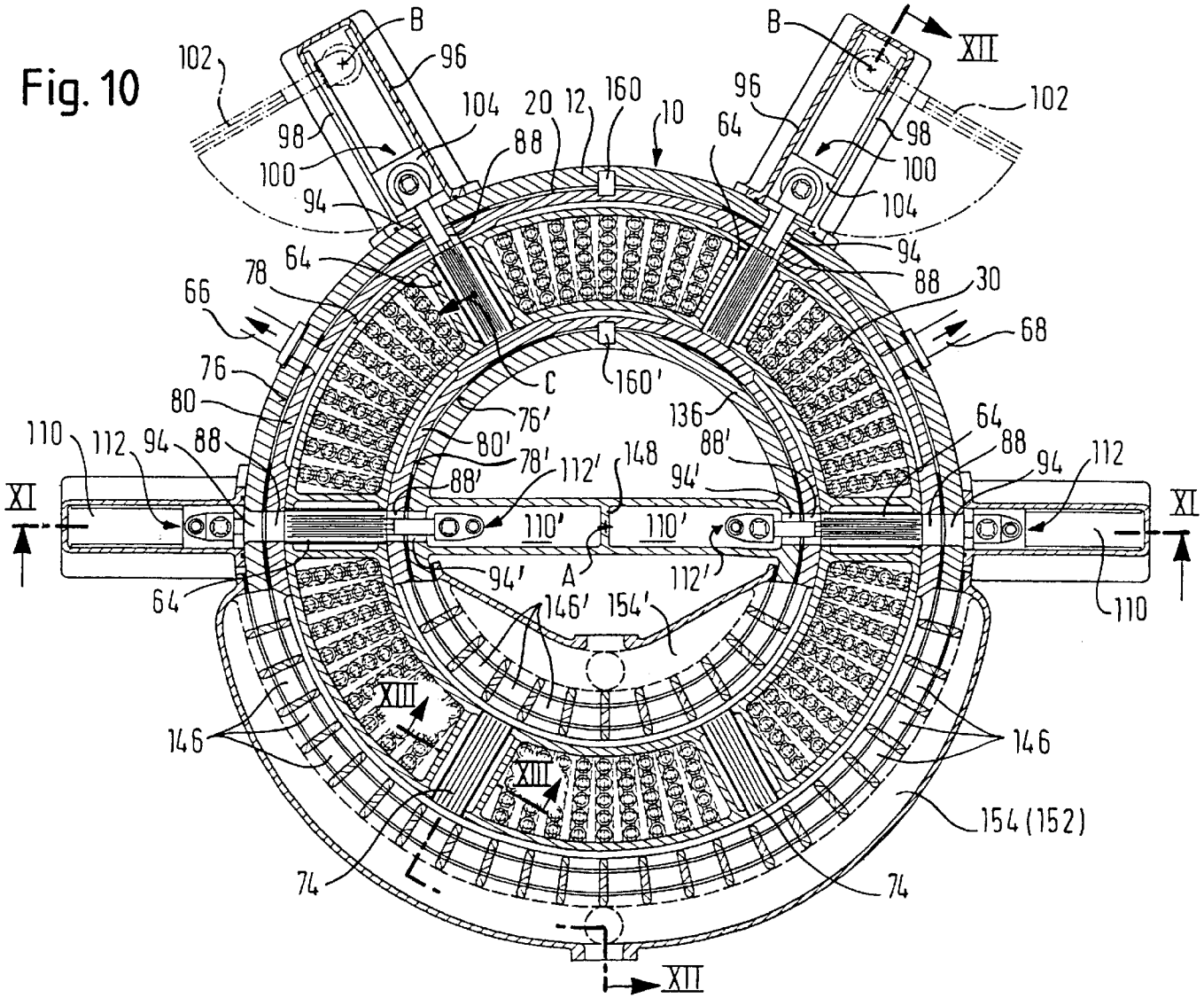
FIG. 10 is a top plan view, partly in horizontal section X—X of FIG. 11, illustrating a third embodiment of a revolving transfer furnace according to the invention.

The outer sealing ring 80 is formed with four outer radial passages 88 at angular spacings of 60° for loading and emptying as well as for evacuating the lock chambers 64. As seen in FIG. 10, these passages 88 are provided in the upper half of the outer sealing ring 80 and they become aligned with a respective one of the lock chambers 64 whenever the lock rotor 60 comes to a standstill. The inner sealing ring 80' is formed with two diametrically opposed, inner radial passages 88' which are aligned with the outer passages 88. Moreover, the sealing rings 80 and 80' each include a rather large number of closely adjacent slots 146 and 146', respectively, in their lower region, as seen in FIG. 10, serving for introduction and discharge of a coolant into and out of the lock chambers 64.

At the level of the lock rotor 60, the outer wall 12 of the furnace body 10 is formed with four outer radial openings 94 mutually offset by 60° and each aligned with a respective one of the passages 88 in the outer sealing ring 80. At the level of the lock rotor 60, the inner wall 136 of the furnace body 10 is formed with two inner radial openings 94' located diametrically opposite each other and each aligned with a respective one of the passages 88' formed in the inner sealing ring 80'. At the outer wall 12 of the furnace body 10, an enclosure 96 each is built radially from outside around two each of the outer openings 94. Each enclosure 96 communicates with the outside surroundings of the furnace body 10 through a respective slot 98 at the level of the lock rotor 60. And each enclosure 96 houses a loading device 100 for introducing and removing batches of workpieces into and out of the lock chambers 64.

The other two diametrically opposed openings 94 in the outer wall 12 of the furnace body 10 open into an outer side chamber 110 each, the latter are hermetically sealed towards the outside and each house a transfer apparatus 112. The inner wall 136 of the furnace body 10 encloses two inner side chambers 110' which are separated by a vertical partition 148 and each contain one of two diametrically opposed transfer apparatus 112'.

Each one of the total of four transfer apparatus 112 and 112' comprises a fin comb 114 and 114', respectively, corresponding to the fin combs 102 of the loading devices 100 but, contrary to them, always being positioned radially and, moreover, adjustable in height along a vertical column 116 and 116', respectively, between positions which correspond to those of the upper and lower turntables 32 and 34, respectively, and of the lock chambers 64. The columns 116 and 116' are each fastened to a respective slide 118 and 118', the latter being displaceable radially towards and away from the central axis A by means of a motor 120 and 120', respectively. Each motor 120 and 120' drives a nut which produces reciprocating motion of a corresponding hollow spindle 122 and 122' fastened to the respective slide 118 or 188'. Another motor 124 and 124', respectively, is provided to produce lifting motions, it is flange-connected coaxially with the respective motor 120 or 120' and drives a corresponding shaft 126 and 126', respectively. The shaft 126, 126' passes through the corresponding hollow spindle 122, 122' and drives a vertical spindle 128, 128' in meshing engagement with the associated fin comb 114, 114' so as to raise and lower the same.

Figure 11:
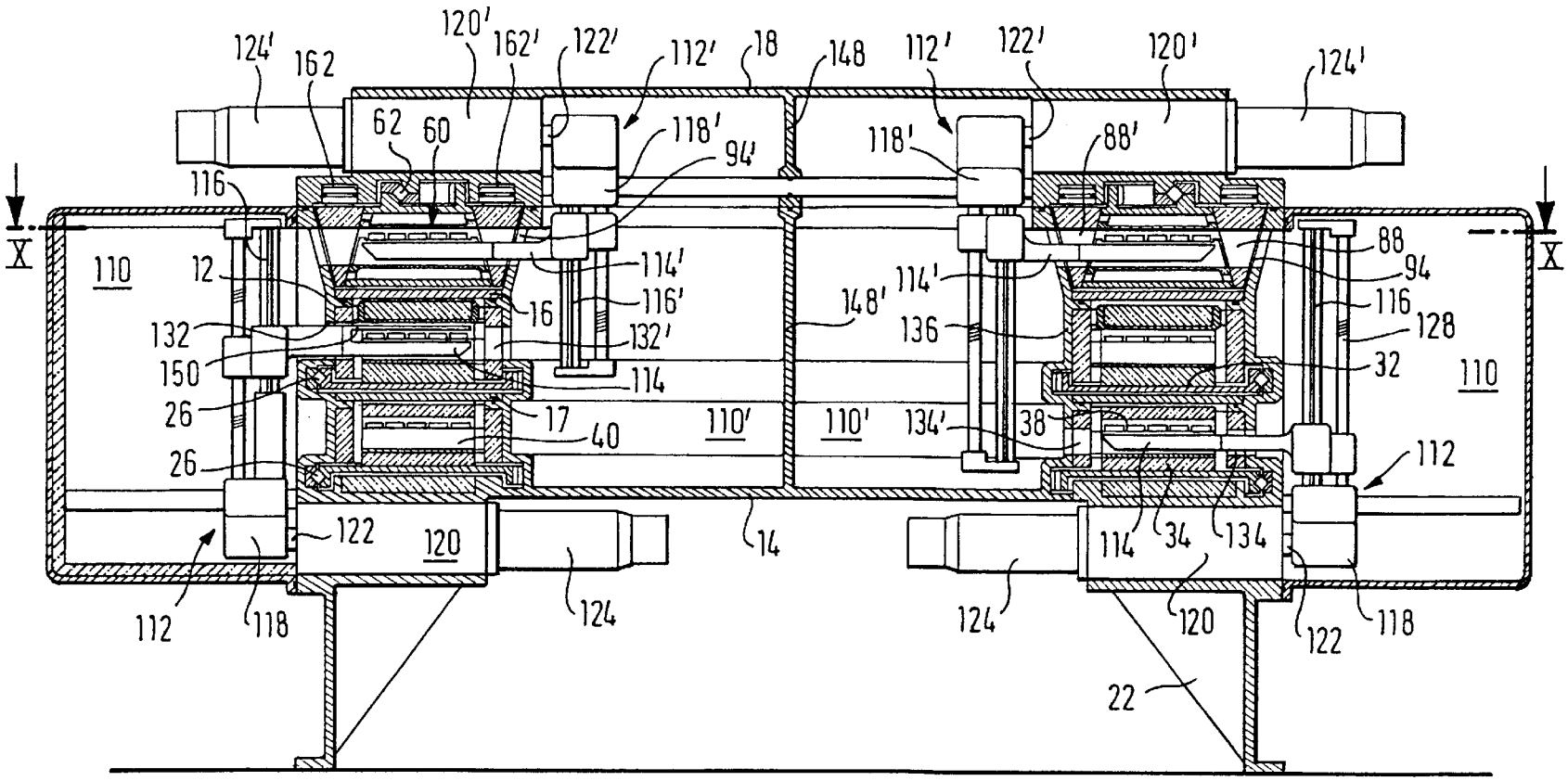
FIG. 11 shows vertical section XI—XI of FIG. 10.

A central outer opening 132 likewise formed in the outer wall 12 opens into the left outer side chamber 110, as seen in FIGS. 10 and 11, in addition to the upper outer opening 94 which connects this side chamber 110 to the lock rotor 60. It is through this opening 132 that the upper turntable 32 can be reached from this outer side chamber 110. Also, this central outer opening 132 is aligned with a central inner opening 132' which is formed in the inner wall 136 and through which the upper turntable 32 can be reached from the inner side chamber 110'. A lower outer opening 134 through which the lower turntable 34 is accessible opens into the right outer side chamber 110, as seen in FIGS. 10 and 11. This lower outer opening 134 is aligned with a lower inner opening 134' formed in the inner wall 136 and through which the lower turntable 34 can be reached from the inner side chamber 110'. All the openings 94, 94', 132, 132', 134, and 134' of the furnace body 10 as well as the passages 88 and 88' in the sealing rings 80 and 80' are dimensioned such that one each of the fin combs 102 and 114 and 114', respectively, can be pushed through to enter between the fins 40 of the treatment rotor 30 or the fins 70 of the lock rotor 60, respectively.

The left outer side chamber 110, as seen in FIGS. 10 and 11, and the associated inner side chamber 110' communicate at all times with the upper turntable 32 and are constantly evacuated, when in operation, just like the corresponding portion of the furnace chamber 20. The right outer side chamber 110 and the associated inner side chamber 110', on the other hand, always communicate with the lower turntable 34 and the portion of the furnace chamber 20 surrounding it so that their atmosphere is the same as the one prevailing there, e.g. hot nitrogen, by which the workpieces are heated to annealing temperature.

The transfer apparatus 112 in the left outer side chamber 110, as seen in FIGS. 10 and 11, is furnished with a heater plate 150 which is located above and spaced from the fin comb 114 to heat the workpieces lying on this fin comb from above, e.g. by electric induction or thermal radiation.

The third embodiment of a revolving transfer furnace according to FIGS. 10 to 14 differs from the first and second embodiments in that the means for quenching the workpieces W comprises coolant supply channels 152 and 152' which extend over a wide angular range of almost 160° in circumferential direction along the outer wall 12 and inner wall 136, respectively, of the furnace body 10. In this manner they always communicate with two, at times even three, successive lock chambers 64 feeding them with coolant, such as cold nitrogen. The coolant is removed through coolant discharge channels 154 and 154', respectively, after having flown through the lock chambers 54 to which the channels are connected. The slots 146 and 146' start at these channels or open into them and they extend through the furnace wall 12 or 136, respectively, and the sealing ring 80 or 80', respectively, permitting simultaneous flow through all the lock chambers 64 which are passing the region between the coolant supply channels 152, 152' and the coolant discharge channels 154, 154' disposed in between.

Figure 14:
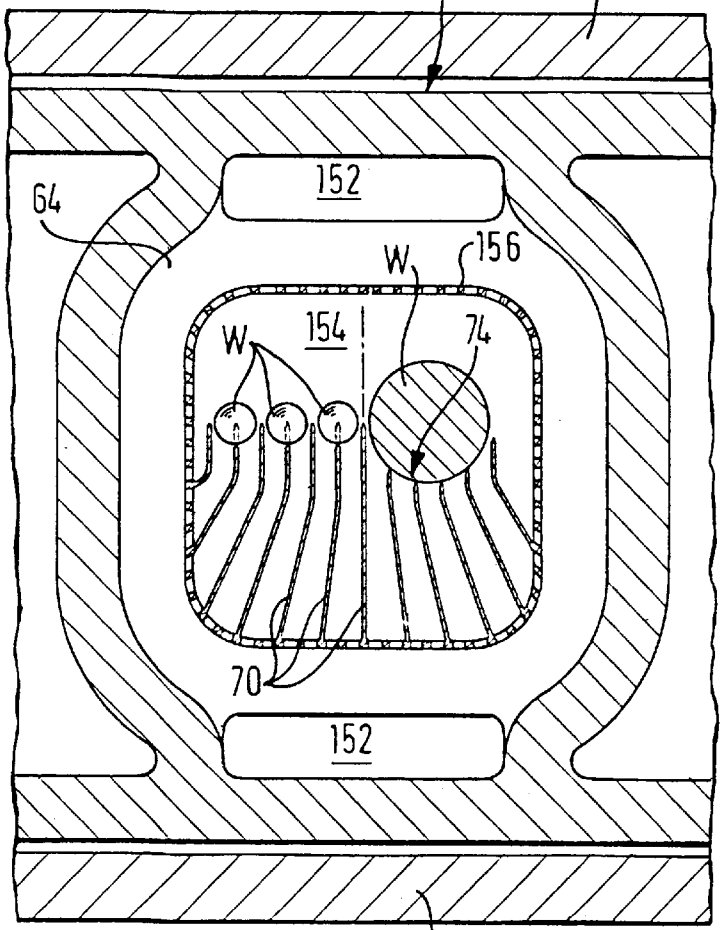
FIG. 14 shows a modification of FIG. 13.
Figure 13:
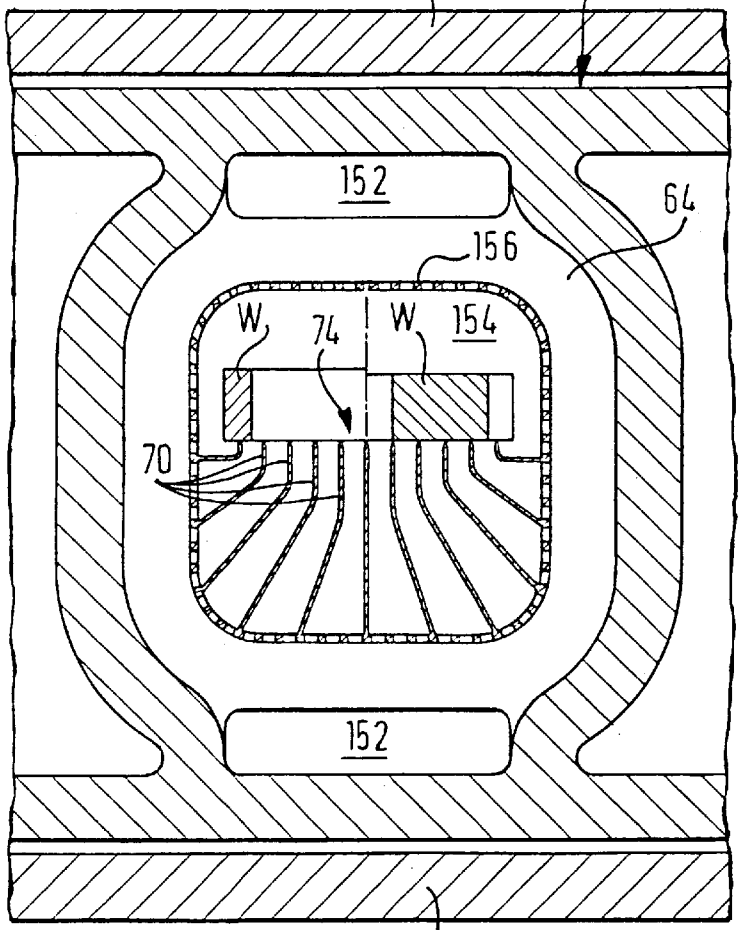
FIG. 13 shows vertical section XIII—XIII of FIG. 10.

As shown in FIGS. 13 and 14, the lock location 74 of each lock chamber 64 is enclosed by an exchangeable sleeve 156 which extends radially with respect to the central axis A, is open radially inwardly and outwardly, made of perforated sheet metal, and supports the associated fins 70. The surroundings of the sleeve 156 communicate with the coolant supply channels 152, 152' while the interior of the sleeve 156 is connected to the coolant discharge channels 154, 154' for as long as the respective lock chamber 64 is moving through the angular region described above of these channels.

Figure 12:
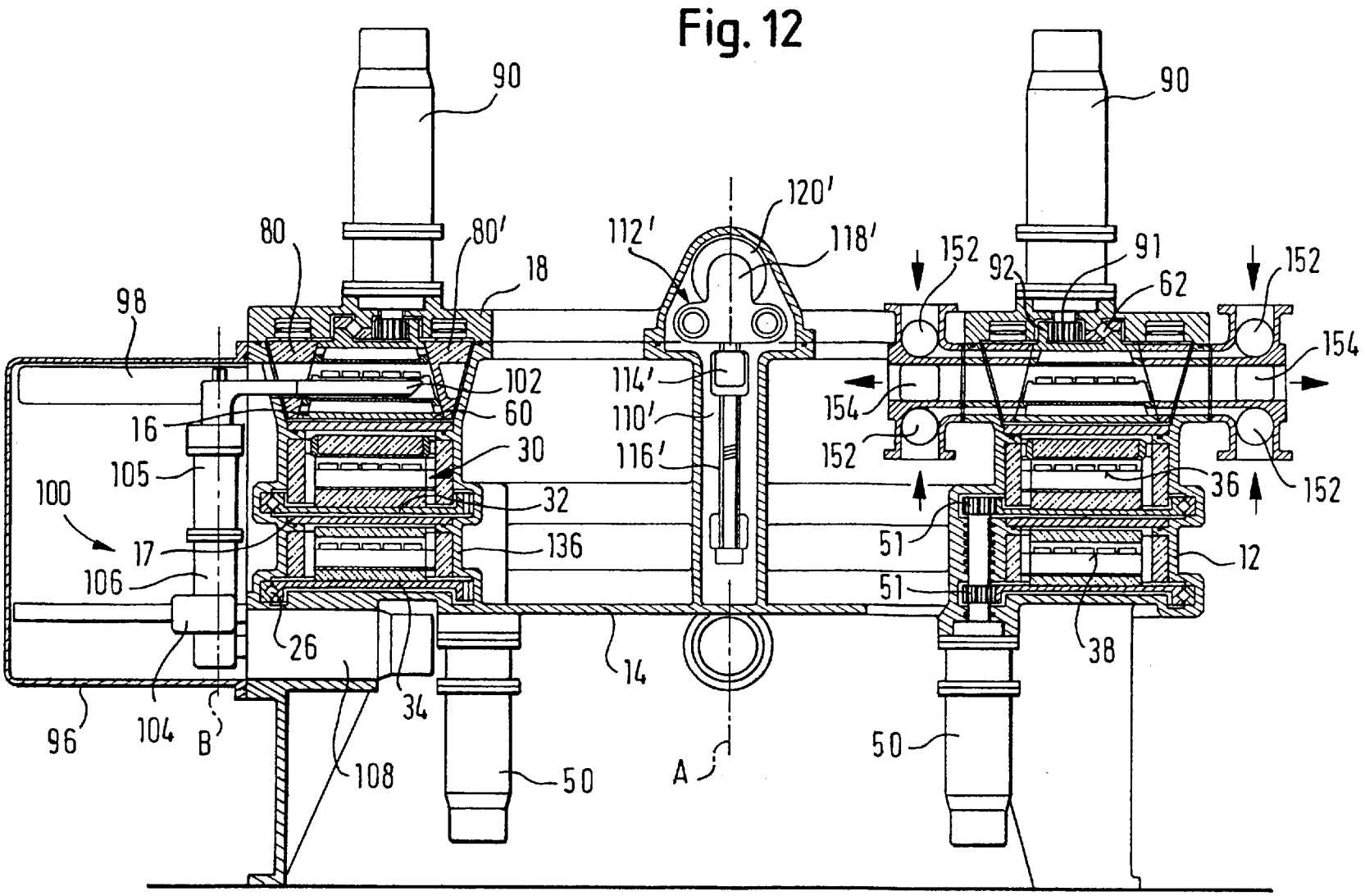
FIG. 12 shows vertical section XII—XII of FIG. 10.

The revolving transfer furnace illustrated in FIGS. 10 to 14 operates as follows:

The fin comb 102 of the loading device 100 located at the left, as seen in FIGS. 10 and 12, is swung out from its associated enclosure 96 and loaded with a batch of workpieces W. Thereupon, the fin comb 102 is swung into its normal radial position and introduced radially into the particular lock chamber 64 which happens to be aligned radially with this fin comb 102. Next, the batch of workpieces are put down on the lock location 74 of the respective lock chamber 64 and the fin comb 102 in question is retracted radially outwardly. Thereafter, the lock rotor 60 is turned by one step in the direction of arrow C in FIG. 10, i.e. through 60° in the example shown. That causes the lock chamber 64 charged with the first batch of workpieces to move past the suction nipple 66 provided at the outer wall 12 of the furnace body 10 and connected to a suction pump. The above mentioned lock chamber 64, having thus been evacuated, then reaches the position at which it will communicate both with the left outer side chamber 110 and the left inner side chamber 110', as seen in FIGS. 10 and 11. The transfer apparatus 112' of the latter side chamber removes the batch of workpieces radially from the lock chamber 64, lowers them to the level of the upper turntable 32 where it pushes the batch of workpieces radially outwardly to the turntable, putting them down on one of the batch locations 36 thereof by an additional minor downward motion. Subsequently, the treatment rotor 30 is turned by one step, i.e. through 5°.

This sequence of operations is repeated for successive lock chambers 64 of the lock rotor 60 and successive batch locations 36 of the upper turntable 32 until the latter has been fully loaded, i.e. with a total of seventy-two batches of workpieces in the selected example.

As soon as the batch of workpieces first loaded on the upper turntable 32 has participated in a full revolution of the treatment rotor 30, having been heated in the course thereof to a certain temperature, as required for tempering for instance, the transfer apparatus 112 in the left outer side chamber 110, as seen in FIGS. 10 and 11, is employed to lift this batch of workpieces from its batch location 36 on the upper turntable 32, maintain the workpieces at tempering temperature by means of the heating plate 150, and place them at the proper lock location 74 in the lock chamber 64 above it. This lock chamber 64 has become free because the simultaneously working transfer apparatus 112' in the left inner side chamber 110' has just translated an untreated batch of workpieces from this lock chamber to the batch location 36 which has just become free.

During the next step of the lock rotor 60, the heated batch of workpieces enters into the realm of action of the coolant supply channels 152, 152' and, as a consequence, the workpieces W of this batch are quenched. As a matter of fact, they may be cooled down to a rather low temperature, such as 5° C. due to the long duration of the coolant action which lasts for as long as almost three steps of the lock rotor 60.

The fourth step of the lock rotor 60 brings the batch of workpieces, now sufficiently cool, to a position between the right outer side chamber 110 and the right inner side chamber 110', as seen in FIGS. 10 and 11. There, the batch of workpieces under consideration is removed from its lock chamber 64 by the inner transfer apparatus 112', working in the right inner side chamber 110', and set down on a batch location 38 of the lower turntable 34. This sequence of operations is repeated until the lower turntable 34, too, is fully occupied, i.e. loaded with seventy-two batches of workpieces in the example shown.

As soon as the batch of workpieces loaded on the lower turntable 34 has taken part once more in a complete revolution of the treatment rotor 30, having been heated in the course to a certain temperature required for annealing, for instance, this batch of workpieces is taken over from its batch location 38 on the lower turntable 34 by the transfer apparatus 112 in the right outer side chamber 110, as seen in FIGS. 10 and 11, and put down at the lock location 74 above it which has just become free.

This lock chamber 64 with its lock location 74 has become available because the transfer apparatus 112' in the right inner side chamber 110', being active at the same time, has moved a quenched batch of workpieces from this lock location to the batch location 38 which had just been made free.

Finally, the batch of workpieces under consideration which was the first to be loaded into the furnace takes part in a sixth step of the lock rotor 60, whereby it is moved past the suction nipple 68 into the working range of the right loading device 100, as seen in FIG. 1. This loading device 100 picks up the batch and then swings it out of the associated enclosure 96 into the open.

Thus the charging of the furnace with batches of workpieces is completed—in the embodiment shown this takes about 22 minutes—and the batches of workpieces in fully heat-treated condition begin to be discharged from the furnace, at intervals of no more than 9 seconds each. At the same time, fresh, untreated batches of workpieces continue to be supplied to the furnace at the same intervals of 9 seconds each. In the selected example, the residence time of the batches of workpieces on the two turntables of the treatment rotor lasts 10.8 minutes each. Prior to any alteration or/and repair of the furnace, the inverse procedure to the charging of the furnace is carried out in order to empty it of its batches of workpieces. That would likewise take approximately 22 minutes in the example shown.

The revolving transfer furnace according to the invention allows practically continuous, fully automatic heat treatment, and the sequence of operations can be completely integrated with and interlinked in the production sequence. Moreover, it offers improvements in quality and quantity in terms of the product.

I claim:

1. A revolving transfer furnace for treating workpieces (W), comprising:

a furnace body (10) enclosing a furnace chamber (20) adapted for an atmosphere which differs from the ambient air to be established inside said chamber, a treatment rotor (30) arranged in the furnace body (10) so as to be driven in rotation about a central axis (A) and comprising a number of batch locations (36) to each take up a batch of workpieces, side chambers (110) connected to the furnace body (10) and designed each for receiving a batch of workpieces from the treatment rotor (30) and for delivering one to the same, at least two lock chambers (64) disposed angularly offset relative to each other with respect to the central axis (A) and being opened alternately to the surroundings of the furnace body (10) and to a side chamber (110) so as to each receive and deliver a batch of workpieces, and transfer apparatus (112) for translating a batch of workpieces each between a respective one of the aforementioned chambers (64, 110) and the treatment rotor (30), characterized in that the lock chambers (64) are located in a lock rotor (60) which likewise is arranged in the furnace body (10) and adapted to be driven in rotation about the central axis (A) such that at least one lock chamber (64) each is periodically opened towards one of the side chambers (110), and at least one of the transfer apparatus (112) is designed to translate one batch of workpieces each between the lock rotor (60) and the treatment rotor (30).

2. The revolving transfer furnace as claimed in claim 1, characterized in that:

the number of batch locations (36) of the treatment rotor (30) located in a common plane is an integer multiple of the number of lock chambers (64) of the lock rotor (60), and both rotors (30, 60) are adapted to be driven stepwise in rotation such that the angular dimension of each step of the lock rotor (60) is the same size multiple of each step of the treatment rotor (30).

3. The revolving transfer furnace as claimed in claim 1, characterized in that the treatment rotor (30) comprises at least two turntables (32, 34) which are axially offset with respect to each other, thermally insulated from each other, and adapted to be heated differently.

4. The revolving transfer furnace as claimed in claim 1, characterized in that at least one coolant channel (152, 154; 152', 154') is arranged at the furnace body (10) so as to extend through an arc corresponding to at least one step of the lock rotor (60) and is separated from adjacent side chambers (110; 110') and communicates throughout its arc length with at least one of the lock chambers (64).

5. The revolving transfer furnace as claimed in claim 1, characterized in that the furnace body (10) comprises at least one annular, stationary sealing surface (76; 76') and the lock rotor (60) comprises a co-rotating sealing surface (78; 78'), and that a sealing ring (80; 80') which is fixed against rotation is disposed between those two sealing surfaces (76, 78; 76', 78') and formed with suitable passages (88), being the same in number and arrangement as the lock chambers (64), to permit a batch of workpieces each to pass.

6. The revolving transfer furnace as claimed in claim 1, characterized in that the central axis (A) is disposed vertically, each batch location (36) comprises a plurality of fins (40) which are disposed substantially radially with respect to the central axis (A) but parallel to one another and essentially on edge, each lock chamber (64) includes a lock location (74) formed by fins (70) which are arranged accordingly, the transfer apparatus (112) each comprise a radially displaceable fin comb (114) which fits between the fins (40, 70) of the batch and lock locations (36, 74), and the fin comb (114) of each transfer apparatus (112) is adapted to be raised and lowered between positions in height corresponding to those of the rotors (30, 60).

7. The revolving transfer furnace as claimed in claim 1, characterized in that at least one side chamber (110) is disposed opposite another side chamber (110') such that one and the same lock chamber (64) as well as one and the same batch location (36) each are simultaneously accessible from these two side chambers (110, 110'), and these two side chambers (110, 110') contain one each of two transfer apparatus (112, 112') which are controllable such that one of them will translate a batch of workpieces from the lock rotor (60) to the treatment rotor (30) while the other one, at the same time, translates a batch of workpieces from the treatment rotor (30) to the lock rotor (60).

8. The revolving transfer furnace as claimed in claim 7, characterized in that both rotors (30, 60) are annular, and at least one inner side chamber (110') is disposed radially within the two rotors (30, 60).

9. The revolving transfer furnace as claimed in claim 8, wherein the treatment rotor (30) comprises at least two turntables (32, 34) which are axially offset with respect to each other, thermally insulated from each other, and adapted to be heated differently, further characterized in that the inner side chamber (110') includes two inner transfer apparatus (112') which face diametrically away from each other, an outer transfer apparatus (112) each, located in a side chamber (110) each, is associated with a respective one of the two inner transfer apparatus (112') in radially opposed relationship, one of the inner transfer apparatus (112') and the respective radially opposed outer transfer apparatus (112) are provided for translating batches of workpieces between the lock rotor (60) and one of the turntables (32), and the other inner transfer apparatus (112') and the respective radially opposed outer transfer apparatus (112) are provided for translating batches of workpieces between the lock rotor (60) and the other turntable (34).

10. The revolving transfer furnace as claimed in claim 9, characterized in that the two turntables (32, 34) are sealed with respect to each other so that a different atmosphere can be maintained at the batch locations (36) of the first turntable (32) from that at the batch locations (38) of the second turntable (34).

11. The revolving transfer furnace as claimed in claim 9, characterized in that at least the side chamber (110) provided for translating the workpieces (W) from the first turntable (32) to the lock rotor (60) comprises a heater by means of which a substantial drop in temperature of the workpieces (W) as early as during translating can be prevented.

12. The revolving transfer furnace as claimed in claim 11, characterized in that the transfer apparatus (112) in the heatable side chamber (110) comprises a heater plate (150).

* * * * *